US005456582A

United States Patent [19]

Firnhaber et al.

[11] Patent Number: 5,456,582

[45] Date of Patent: Oct. 10, 1995

[54] COMPRESSOR INLET VALVE WITH IMPROVED RESPONSE TIME

[75] Inventors: Mark A. Firnhaber, LaPorte; Sylvester Poplawski, Michigan City, both of Ind.

[73] Assignee: Sullair Corporation, Michigan City, Ind.

[21] Appl. No.: 173,632

[22] Filed: Dec. 23, 1993

[51] Int. Cl.[6] ..... F04B 49/08

[52] U.S. Cl. ..... 417/295; 417/432; 418/201.2; 251/54

[58] Field of Search ..... 417/295, 432, 417/507; 418/201.2; 251/48, 54, 63.4

[56] References Cited

U.S. PATENT DOCUMENTS

| | | | |
|---|---|---|---|
| 1,831,601 | 11/1931 | Le Valley | 251/54 |
| 2,234,488 | 3/1941 | Dick | 230/31 |
| 2,997,227 | 8/1961 | Ternent | 230/31 |
| 3,260,444 | 7/1966 | Williams et al. | 230/138 |
| 3,796,515 | 3/1974 | Lindqvist et al. | 417/23 |
| 3,873,239 | 3/1975 | Jamieson | 417/281 |
| 4,068,980 | 1/1978 | Fine et al. | 417/282 |
| 4,406,589 | 9/1983 | Tsuchida et al. | 417/295 |
| 4,708,599 | 11/1987 | Suzuki | 417/295 |
| 4,815,950 | 3/1989 | Aoki et al. | 417/253 |
| 4,968,221 | 11/1990 | Noll | 417/295 |
| 5,009,576 | 4/1991 | Gagnet | 417/295 |
| 5,018,947 | 5/1991 | Tsuboi | 417/295 |
| 5,388,967 | 2/1995 | Firnhaber et al. | 417/295 |

FOREIGN PATENT DOCUMENTS 587917 5/1947 United Kingdom .

*Primary Examiner*—Richard A. Bertsch
*Assistant Examiner*—Charles G. Freay
*Attorney, Agent, or Firm*—Wood, Phillips, VanSanten, Clark & Mortimer

[57] ABSTRACT

A compressor has an air inlet valve for controlling air intake when demand for service air from the compressor changes. The valve has a housing with an inlet and an outlet which is connected to a compressor. A rod in the housing is movable relative to the housing and has a shoulder and a piston. A movable valve member is mounted on the rod and a spring is interposed between the piston and the housing for moving the shoulder into engagement with the valve member and biasing the valve member toward the closed position. The housing has a chamber on each side of the piston for receiving air that discharges from the compressor. Air pressure is connected to one of the chambers to move the valve member toward the closed position when the pressure of air in the receiver tank exceeds a set-point. Air pressure is disconnected from the one chamber to reduce bias on the valve member whereby the valve member is permitted to move away from the closed position when the pressure of air in the receiver tank is less than the set-point. The one chamber contains liquid to reduce the volume of air receivable in the chamber and thereby reduce the amount of time required for pressure of air in the chamber to a) increase and move the valve member toward the closed position after pressure of air in the receiver tank exceeds the set-point and b) decrease and reduce bias on the valve member after pressure of air in the receiver tank is less than the set-point.

7 Claims, 1 Drawing Sheet

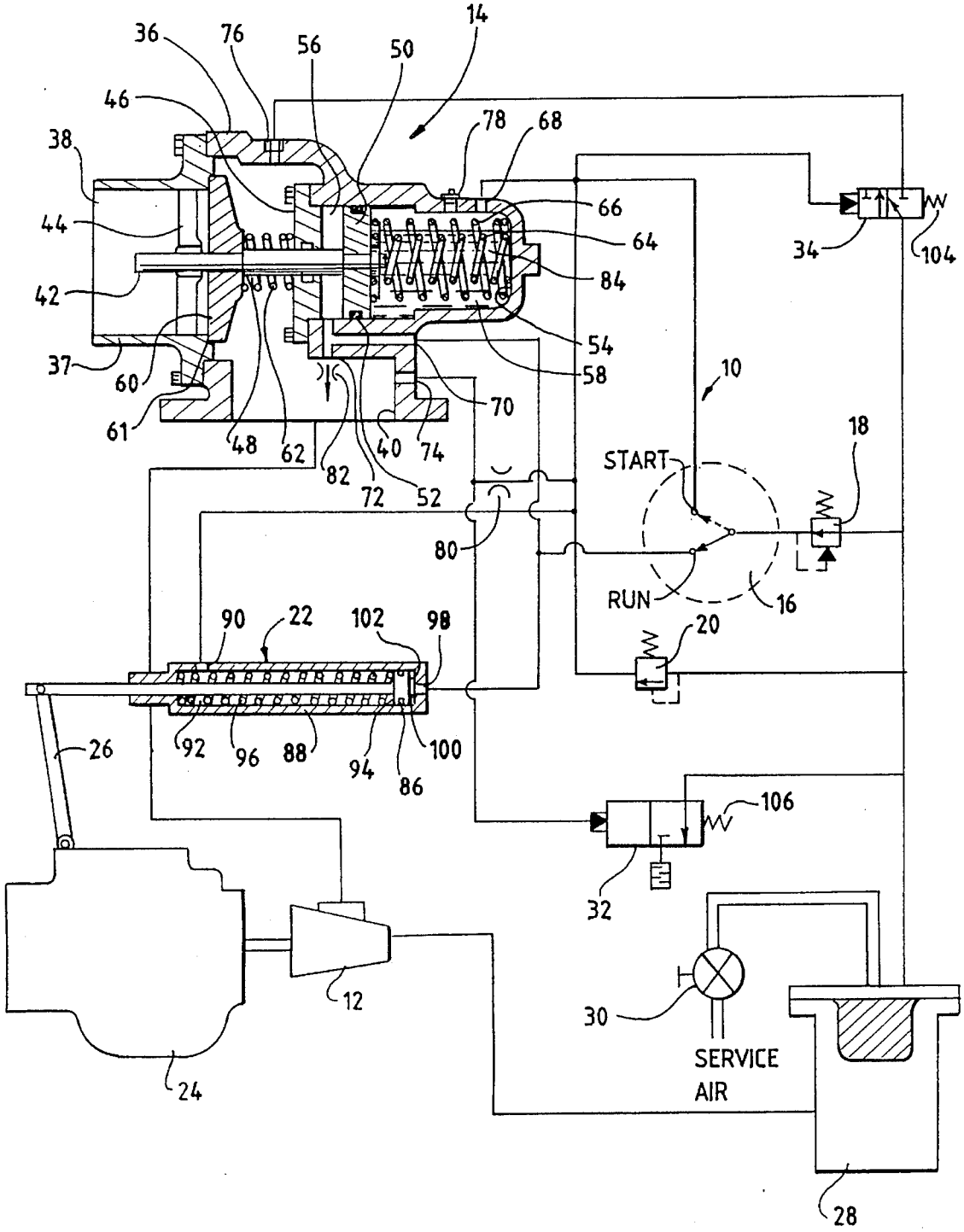
14
36
76
56
50
46
78
68
38
66
44
64
34
104
42
84
54
37
58
60
10
70
61
48
62
40
74
18
START
82
72
52
80
RUN
16
90
22
102
98
20
26
92
96
88
94
100
86
106
32
12
30
SERVICE
AIR
24
28

COMPRESSOR INLET VALVE WITH IMPROVED RESPONSE TIME

BACKGROUND OF THE INVENTION

1. Technical Field

This invention is an apparatus for controlling flow into a compressor, and more particularly is a valve for controlling air intake when demand for service air from a compressor changes.

2. Background Art

A rotary screw air compressor has a pair of parallel rotors which are rotated oppositely relative to each other by a prime mover, such as an internal combustion engine or an electric motor. The rotors have intermeshed oppositely-pitched helical grooves. Operation of a compressor creates a negative pressure which draws air between the rotors and into the grooves. Air in the grooves is compressed when the intermeshed rotors rotate. Compressed air discharges from the grooves and is stored in a receiver tank. A manual service air valve selectively releases air from the tank for performing a task requiring application of air under pressure.

Pressure of air in the receiver tank increases when the service air valve is closed and air intake and rotor speed remain constant. Pressure of air in the receiver tank decreases when the service air valve is opened and air intake and rotor speed remain constant. Applicants' prior U.S. patent application Ser. No. 08/029,151 filed Mar. 10, 1993, now U.S. Pat. No. 5,388,967 and assigned to the assignee of this application, discloses a control and air inlet valve for controlling air intake and rotor speed in response to change in receiver tank pressure whereby air intake and rotor speed reduce when receiver tank pressure exceeds a pressure set-point and air intake and rotor speed increase when receiver tank pressure is less than the pressure set-point.

The inlet valve has a piston which controls movement of a valve member toward and away from a position in which the compressor air inlet is at least partially closed. A spring is located in a chamber on the one side of the piston and biases the valve member toward the closed position. Air from the receiver tank applies pressure against an opposite side of the piston and reduces bias on the valve member. Receiver tank pressure is admitted into the spring chamber when tank pressure exceeds the pressure set-point. Tank pressure in the chamber assists the spring bias the valve member toward the closed position and reduce air intake. Tank pressure is removed and pressure bleeds from the spring chamber to reduce bias on the valve member when tank pressure is less than the pressure set-point so that the valve member is permitted to move away from the closed position and increase air intake.

Response time of the control is a function of the time required to pressurize and de-pressurize the chamber, which, in turn, is a function of the air volume of the chamber. A difficulty with the applicants' above-discussed air inlet valve is that due to the volume of the chamber required to house the bias spring, the control can be unacceptably slow to respond to sudden changes in receiver tank pressure which occur when the service air valve is opened or closed.

Specifically, time required to increase pressure of air in the spring chamber to move the valve member toward the closed position after tank pressure exceeds the set-point results in a lag in the control. Time lag to close the inlet valve causes a spike in the system air pressure which can cause unwanted opening of a safety relief valve. Time required to bleed air from and decrease pressure of air in the spring chamber after tank pressure falls below the setpoint results in a lag before the piston reduces bias on the valve member and the valve member is permitted to move away from the closed position. Time lag to move the valve member away from the closed position causes a drop in the system air pressure.

SUMMARY OF TEE INVENTION

An inlet valve for controlling flow into a compressor has a housing with an inlet and an outlet which is connected to a compressor. A rod in the housing is movable relative to the housing and has a shoulder and a piston. A movable valve member is mounted on the rod between the compressor inlet and the shoulder and a spring is interposed between the valve member and the housing for biasing the valve member toward a closed position in which the compressor inlet is at least partially closed. A second spring is interposed between the piston and the housing for moving the shoulder into engagement with the valve member and biasing the valve member toward the closed position.

The housing has a chamber on each side of the piston for receiving air which discharges from the compressor. Air pressure in a first one of the chambers assists the first spring and the second spring move the valve member toward the closed position when the compressor is in a start mode of operation. Air pressure in a second one of the chambers applies force to the piston in opposition to the second spring to move the shoulder away from the valve member and thereby reduce bias on the valve member so that the valve member is permitted to move away from the closed position when the compressor is in a run mode of operation.

The inlet valve is used in a control having a control regulator which selectively connects and disconnects the first chamber with air in the receiver tank when receiver tank pressure exceeds a set-point and is less than the set point, respectively. The control regulator opens when the pressure of air in the receiver tank exceeds the set-point so that pressure of air in the first chamber gradually increases. Air intake of the compressor is reduced when the volume of air in the first chamber has a pressure sufficient to move the valve member toward the closed position. The pressure of air in the first chamber gradually decreases when the control regulator closes. Air intake increases when the pressure of air in the first chamber is low enough that air pressure in the second chamber reduces bias on the piston and permits negative pressure (that is, suction) in the compressor inlet to move the valve member away from the closed position.

The first chamber is partially filled with liquid to reduce the volume of air receivable in the first chamber and thereby decrease the amount of time required for pressure of air in the first chamber to a) increase and move the valve member toward the closed position after pressure of air in the receiver tank exceeds the set-point and b) decrease and reduce bias on the valve member after pressure of air in the receiver tank is less than the set-point.

BRIEF DESCRIPTION OF THE DRAWING

The FIGURE is a schematic drawing of a compressor control having an air inlet valve according to the present invention.

DESCRIPTION OF THE PREFERRED EMBODIMENT

FIG. 1 shows a control, generally designated 10, for an air compressor 12. The control 10 includes an air inlet valve 14, a two position start-run valve 16, a pressure reducing regulator 18, a control regulator 20, and an engine speed control 22. A prime mover, such as an internal combustion engine 24, is controlled by a throttle 26 and drives the compressor 12. Operation of the compressor 12 causes air which is received from the air inlet valve 14 to be compressed and discharged into a receiver tank 28. Compressed air releases from the receiver tank 28 through the pressure regulator 18 and start-run valve 16, the control regulator 20, a service air valve 30, a blow down valve 32, and a recirculation valve 34.

The control 10 changes air intake of the compressor 12 and output of the engine 24 when pressure of air in the receiver tank 28 deviates from a pressure set-point. As described below, the control regulator 20 opens to decrease air intake and engine output when pressure of air in the receiver tank 28 exceeds the pressure set-point. The control regulator 20 closes to increase air intake and engine output when pressure of air in the receiver tank 28 is below the pressure set-point. The present invention is directed toward increasing the responsiveness of the air inlet valve 14 to operation of the control regulator 20.

The air inlet valve 14 has a housing 36 with a cylindrical wall 37 defining a compressor inlet 38 and an outlet 40 connected to the compressor 12. A rod 42 is mounted for axial movement in the housing 36 on two guides 44 and 46. The rod 42 has a shoulder 48 located between the guides 44 and 46. A piston 50 with an O-ring 52 is secured to the rod 42 between the guide 46 and an end wall 54 of the housing 36 to define a pair of chambers 56 and 58 on opposite sides of the piston 50. A valve member 60 is slidable on the rod 42 between the shoulder 48 and a seat 61 on the housing 36 and a spring 62 is interposed between the valve member 60 and the guide 46 for biasing the valve member 60 toward the compressor inlet 38. Coaxial springs 64 and 66 in the chamber 58 apply force to the piston 50 and urge the shoulder 48 on the rod 42 into engagement with the valve member 60. The springs 64 and 66 thereby assist the spring 62 bias the valve member 60 toward the compressor inlet 38.

A plurality of ports or openings 68, 70, 72, 74, 76 and 78 are provided in the outer wall of the housing 36.

The port 68 connects the chamber 58 with the start-run valve 16, the control regulator 20, the recirculation valve 34, and a bleed orifice 80.

The port 70 connects the chamber 56 with the start-run valve 16.

The port 72 connects the chamber 56 with a bleed orifice 82 in the valve outlet 40.

The port 74 connects the outlet 40 with the bleed orifice 80 and the blow down valve 32.

The port 76 connects the interior of the housing 36 with the recirculation valve 34.

The port 78 permits the chamber 58 to be filled with liquid 84, as described below.

The engine speed control 22 has a piston 86 connected to the throttle 26 and movable within a cylinder 88 between an idle position in which the piston 86 is positioned toward the right end of the cylinder 88 in FIG. 1 and an active position in which the piston 86 is positioned toward the left end of the cylinder 88 in FIG. 1. The cylinder 88 has a port 90 for connecting a chamber 92 on a side 94 of the piston 86 with the control regulator 20. A spring 96 in the chamber 92 biases the piston 86 toward the idle position. A port 98 in the cylinder 88 connects a chamber 100 on an opposite side 102 of the piston 86 with the start-run valve 16.

The control 10 operates as follows. The engine 24 is started when the start-run valve 16 is in a start position (phantom line in FIG. 1). Operation of the compressor 12 creates a negative pressure in the outlet 40 of the valve housing 36. Negative pressure tends to draw air into the valve housing 36 through the inlet 38. Force applied by the springs 62, 64 and 66 to the valve member 60 opposes the negative pressure created by the compressor 12 minimizing air in the compressor 12 and load on the engine 24.

Air pressure from the receiver tank 28 is supplied through the normally open pressure regulator 18 and through the port 68 into the chamber 58 to assist holding the valve member 60 closed when the start-run valve 16 in the start position. Air pressure in the receiver tank 28 also is supplied through the port 90 into the chamber 92 in the engine speed control 22 and together with the spring 96 holds the piston 86 in the idle position.

The start-run valve 16 manually is moved to a run position after the engine 24 is adequately warmed up. When the start-run valve 16 is in the run position, pressure from the receiver tank 28 is supplied through the port 70 into the chamber 56. Pressure of air in the chamber 56 applies force to move the piston 50 to the right in opposition to the bias of the springs 64 and 66 so that valve member 60 is released and moves axially back and forth along the rod 42 against the spring 62 depending on compressor inlet pressure. Air in the chamber 58 is displaced through the port 68 and bleeds through the orifice 80 into the valve outlet 40 when the piston 50 moves to the right.

Air from the receiver tank 28 also flows through the port 98 into the chamber 100 in the engine speed control 22 when the start-run valve 16 is in the run position. Pressure of air in the chamber 100 applies force to the engine control piston 86 in opposition to the spring 96 and moves the piston 86 toward the active position. Output of the engine 24 increases when the piston 86 moves toward the active position. Air in the chamber 92 is displaced through the port 90 and bleeds through the orifice 80 into the valve outlet 40 when the piston 86 moves toward the active position.

Air in the inlet valve chamber 56 and the engine control valve chamber 100 continuously bleeds through the orifice 82 into the valve outlet 40. The pressure reducing regulator 18 and the bleed orifice 80 maintain generally constant air pressure in the chambers 56 and 100. In the exemplary embodiment, the orifice 82 has a diameter of approximately 0.093 inches and together with the pressure reducing regulator 18 maintains generally constant air pressure of approximately sixty pounds per square inch gage in the chambers 56 and 100 when the start-run valve 16 is in the run position.

The control regulator 20 opens when air in the receiver tank 28 exceeds a pressure set-point. Pressure in the receiver tank 28 can exceed the set-point when a demand for service air is discontinued (that is, when the service air valve 30 is closed) and air intake and engine output do not change. Receiver tank pressure in excess of regulated system pressure 28 is supplied to the inlet valve chamber 58, the engine control valve chamber 92, and the bleed orifice 80 when the control regulator 20 opens. Pressure of air in the chamber 58 acts on the piston 50 to engage the shoulder 48 with the valve member 60 and move the valve member 60 toward the closed position to reduce air intake. Air is displaced from the chamber 56 through the bleed orifice 82. Pressure of air in the chamber 92 acts on the engine control piston 86 to move the throttle 26 toward the idle position and reduces engine output. Air is displaced from the chamber 100 through port 98 and the bleed orifice 82.

The control regulator 20 in combination with the bleed orifice 80 provides a gradually increasing pressure signal to the inlet valve chamber 58 and the engine control valve chamber 92 when pressure increases in the receiver tank 28 to provide smooth operation of the inlet valve 14 and the engine speed control 22. In the preferred embodiment, the bleed orifice 80 has a diameter of approximately 0.062 inches.

The control regulator 20 closes when the pressure of air in the receiver tank 28 is less than the pressure set-point, such as when the service air valve 30 is opened and air intake and engine output do not change. Air from the receiver tank 28 is disconnected from the inlet valve chamber 58 and the engine control chamber 92 when the control regulator 20 closes and pressure in the chambers 58 and 92 bleeds through the orifice 80. Pressure of air in the chamber 56 reduces bias on the piston 50 and permits negative pressure in the valve outlet 40 to move the valve member 60 away from the closed position. The piston 50 displaces air in the chamber 58 through the opening 68 and the bleed orifice 80 when the valve member 60 moves away from the closed position. Pressure of air in the engine control valve chamber 100 moves the piston 86 toward the active position and increases engine output. Air in the chamber 92 is displaced through the opening 90 and the bleed orifice 80 when the piston 86 moves toward the active position.

The recirculation valve 34 normally is closed and opens when pressure in the inlet valve chamber 58 applies a force which exceeds the stiffness of a recirculation valve spring 104. Scavenge air flows from the receiver tank 28 and into the compressor 12 through the port 76 in the housing 36 when the recirculation valve 34 opens. Circulation of scavenge air through the compressor 12 eliminates oil cavitation noise.

The blow down valve 32 normally is closed and opens when pressure in the outlet 40 applies a force which exceeds the stiffness of a blow down valve spring 106. Air releases from the receiver tank 28 when the blow down valve 32 opens. Pressure in the outlet 40 increases, for example, when the compressor 12 ceases operating and the air inlet valve 14 is closed. The blow down valve 32 thus is operative to vent pressure in the receiver tank 28 to atmosphere when the compressor 12 is shut down.

The chamber 58 is partially filled with liquid 84, such as, for example, oil, prior to operating the control 10. The liquid 84 reduces the volume of air which can be received in the chamber 58 and thereby reduces the time required for the piston 50 to move in response to actuation of the control regulator 20. Prior to operating the control 10, liquid 84 is poured through the port 78 to substantially fill the chamber 58 when the piston 50 in a fully retracted position (that is, when the piston 50 is in a leftmost position adjacent the guide 46 in FIG. 1). The port 78 then is closed and the piston 50 is fully stroked to the right to displace a portion of the liquid 84 through the port 68. When the piston 50 moves to the fully retracted (leftmost) position, a volume of air equal to the maximum displacement of the piston 50 is drawn into the chamber 58 through the port 68. In one embodiment, the piston 50 has a one-inch stroke and a maximum displacement of approximately twenty cubic inches. The volume of air in the partially liquid-filled chamber 58 thus is approximately twenty cubic inches.

The control regulator 20 opens and admits air from the receiver tank 28 into the chamber 58 when the pressure of air in the receiver tank 28 exceeds the pressure set-point of the control regulator 20, as discussed above. The pressure of air in the chamber 58 gradually increases while air from the receiver tank flows into the chamber 58. Air intake of the compressor 12 decreases when the air in the chamber 58 reaches a pressure sufficient to move the valve member 60 toward the closed position. The time required for air in the chamber 58 to reach the pressure necessary to move the valve member 60 is proportional to the air volume of the chamber 58. The liquid 84 reduces the air volume of the chamber 58 so that pressure of air in the chamber 58 increases when the control regulator 20 opens more rapidly than if the liquid 84 is not present.

The liquid 84 thus reduces the response time of the inlet valve 14 when a demand for service air is discontinued. In the exemplary embodiment, sudden closing of the service air valve 30 results in a spike in receiver tank pressure of approximately 30–50 psi above set-point pressure when the control 10 is operated without liquid 84 in the chamber 58. Closing of the service air valve 30 results in a spike in receiver tank pressure of approximately 15–20 psi above set-point pressure when the chamber 58 contains the volume of oil described above.

The liquid 84 also reduces the response time of the control 10 when the service air valve 30 opens and pressure decreases in the receiver tank 28. The control regulator 20 closes when the pressure of air in the tank 28 is less than the set-point and pressure of air in the chamber 58 gradually decreases while air in the chamber 58 bleeds through the orifice 80. Air intake of the compressor 12 increases when the pressure of air in the chamber 58 is low enough that air pressure in the chamber 56 moves the piston 50 in opposition to the springs 64 and 66 and permits negative pressure in the valve outlet 40 to move the valve member 60 away from the closed position. The time required for air pressure in the chamber 58 to bleed to the pressure necessary to allow movement of the piston 50 is proportional to the air volume of the chamber 58. The liquid 84 reduces the air volume of the chamber 58 so that pressure of air in the chamber 58 decreases when the control regulator 20 closes more rapidly than if the liquid 84 is not present.

In the exemplary embodiment, opening of the service air valve 30 results in a drop in receiver tank pressure of approximately 20–40 psi below set-point pressure before the inlet valve 14 fully opens when the control 10 is operated without liquid 84 in the chamber 58. Opening of the service air valve 30 results in a drop in receiver tank pressure of approximately 5–10 psi below set-point pressure when the chamber 58 contains oil in the volume described above.

Another advantage of the liquid 84, such as oil, in the chamber 58 is that the oil 84 continuously lubricates the piston 50 and the O-ring 52. Oil which leaks past the O-ring 52 drains through the port 72 and into the compressor 12 since the bleed orifice 82 is located inside the inlet valve 14. Oil which is displaced through the port 68 by the piston 50 drains into the compressor 12 since the bleed orifice 80 is connected to the inlet valve port 74. Oil is prevented from discharging when the piston 50 is stroked since the air volume of the partially-filled chamber 58 is substantially equal to the maximum displacement of the piston 50 and since the port 68 is located on the top of the valve housing 36.

We claim:

1. A valve for controlling flow to a compressor, comprising:

a housing having an inlet, and an outlet connected to a compressor;

a rod in the housing;

a shoulder on the rod;

means for mounting the rod for movement relative to the housing;

a valve member movable along the rod;

a first spring between the valve member and the housing for biasing the valve member toward a closed position in which the housing inlet is at least partially closed;

a piston on the rod, said piston having opposed sides;

a first chamber in the housing on one of said piston sides;

a second chamber in the housing on the other of said piston sides;

a second spring in the second chamber between the piston and the housing for moving the shoulder into engagement with the valve member and biasing the valve member toward said closed position;

a first opening in the housing for connecting said first chamber to a supply of air discharged by the compressor, air in said first chamber having a pressure that acts against said one piston side in opposition to the second spring for moving the rod away from the inlet and disengaging the shoulder from the valve member;

a second opening in the housing for connecting said second chamber to said supply when the pressure of air in said supply exceeds a set-point and for discharging air from said second chamber when the pressure of air in said supply is less than the set-point and said second opening is disconnected from the supply, air in said second chamber having a pressure that acts against said other piston side and assists the first spring and the second spring move the valve member toward the closed position; and liquid in said second chamber for reducing the volume of air receivable in said second chamber and thereby reducing the amount of time required for pressure of air in the second chamber to a) increase and move the valve member toward the closed position when the second chamber is connected to said supply and b) decrease and reduce bias on the valve member when the second chamber is disconnected from said supply.

2. The valve of claim 1 in which the second chamber has an air volume approximately equal to the displacement of the piston.

3. The valve of claim 1 in which the liquid is oil.

4. The valve of claim 1 in which the housing has an opening connecting the second chamber to said outlet so that liquid displaced from said chamber when the rod moves away from the inlet is directed into the compressor.

5. The valve of claim 1 in which the housing has an opening connecting the first chamber to said outlet so that liquid from said second chamber which leaks into said first chamber is directed into the compressor.

6. In a control for a compressor which discharges air into a tank, the control including an inlet valve for controlling flow to the compressor, the inlet valve having a housing with an inlet and an outlet and a piston movable in the housing between a first position in which the inlet valve is at least partially closed and a second position in which the inlet valve is open, said piston having opposed sides, the inlet valve having a first chamber on one of said piston sides and a second chamber on the other of said piston sides, a spring for biasing the piston toward said first position, means for directing air from said tank into said first chamber, air in said first chamber having a pressure that acts against said piston in opposition to the spring and reduces bias on the piston whereby the piston is permitted to move to the second position, and an opening for admitting air from the tank into said second chamber; and a regulator between the inlet valve and the tank for connecting said second chamber to the tank when the pressure of air in the tank exceeds a set-point and for disconnecting the second chamber from the tank when the pressure of air in said tank is less than the set-point, air in said second chamber having a pressure that acts against said piston and assists the spring bias the piston toward the first position; the improvement comprising liquid in said second chamber for reducing the volume of air receivable in said second chamber and thereby reducing the amount of time required for pressure of air in the second chamber to a) increase and move the piston toward the first position after the tank is connected to the second chamber and b) decrease and reduce bias on the piston after the tank is disconnected from the second chamber.

7. A valve comprising:

a housing having an inlet and an outlet;

a piston movable in the housing between a first position for at least partially closing the valve and a second position in which the valve is permitted to open, said piston having opposed sides;

a chamber on each side of the piston;

a spring located in one of the chambers for biasing the piston toward the first position;

a first opening in the housing for connecting a first one of said chambers to a supply of air, air in said first chamber having a pressure that acts against said piston in opposition to the spring and reduces bias on the piston whereby the piston is permitted to move toward the second position, a second opening in the housing for connecting a second one of said chambers to a supply of air when the pressure of air in the supply exceeds a set-point and for discharging air from said second chamber when the pressure of air in said supply is less than the set-point and said second opening is disconnected from the supply, air in said second chamber having a pressure that acts against said piston and assists the spring bias the piston toward the first position; and liquid in said second chamber for reducing the volume of air receivable in said second chamber and thereby reducing the amount of time required for pressure of air in the second chamber to a) increase and move the piston toward the first position when the second chamber is connected to the supply and b) decrease and reduce bias on the piston when the second chamber is disconnected from the supply.

* * * * *